US009426563B2

(12) United States Patent
Gasparini et al.

(10) Patent No.: US 9,426,563 B2
(45) Date of Patent: Aug. 23, 2016

(54) MEMS SPEAKER DEVICE WITH AN ELECTRONIC TEST CIRCUIT

(71) Applicant: STMicroelectronics S.r.l., Agrate Brianza (IT)

(72) Inventors: Alessandro Gasparini, Cusano Milanino (IT); Daniele Depascalis, Cornaredo (IT)

(73) Assignee: STMICROELECTRONICS S.R.L., Agrate Brianza (IT)

( * ) Notice: Subject to any disclaimer, the term of this patent is extended or adjusted under 35 U.S.C. 154(b) by 282 days.

(21) Appl. No.: 14/030,584

(22) Filed: Sep. 18, 2013

(65) Prior Publication Data

US 2014/0093089 A1 Apr. 3, 2014

(30) Foreign Application Priority Data

Sep. 28, 2012 (IT) ..... TO2012A0853

(51) Int. Cl.
*H04R 3/00* (2006.01)
*H04R 19/01* (2006.01)
*H04R 29/00* (2006.01)

(52) U.S. Cl.
CPC ..... *H04R 3/00* (2013.01); *H04R 19/013* (2013.01); *H04R 29/001* (2013.01)

(58) Field of Classification Search
CPC ..... H04R 3/00; H04R 3/12
USPC ..... 340/544, 573.1; 381/59, 300, 309, 311, 381/26, 85, 89, 332, 96, 111, 116, 117
See application file for complete search history.

(56) References Cited

U.S. PATENT DOCUMENTS 4,692,743 A * 9/1987 Holden ..... G08B 13/20 340/544
2008/0094226 A1* 4/2008 O'Shea ..... A61B 5/0002 340/573.1
2010/0278363 A1 11/2010 Yang et al.

FOREIGN PATENT DOCUMENTS

WO 02/49199 A1 6/2002

OTHER PUBLICATIONS

O'Brien et al., "Integrated extension sensor based on resistance and voltage measurement for a dielectric elastomer," *Proc. of SPIE 6524*, 2007, 12 pages.

* cited by examiner

*Primary Examiner* — Md S Elahee
(74) *Attorney, Agent, or Firm* — Seed IP Law Group PLLC

(57) ABSTRACT

A MEMS speaker device including a membrane that forms a first capacitor and a second capacitor, respectively, with a top plate and with a bottom plate. The device includes a driving circuit that operates, during a first operating period, to move the membrane into a first position, in which the membrane is close to the bottom plate, and during a second operating period, to move the membrane into a second position, in which the membrane is close to the top plate. The device includes a testing circuit having a measuring circuit, which generates a first signal, based on a capacitance of one of the first capacitor and the second capacitor and a second signal based on a capacitance of one of the first capacitor and the second capacitor; and a comparator, which compares the first and second signals with at least one first electrical reference quantity.

21 Claims, 9 Drawing Sheets

MEMS SPEAKER DEVICE WITH AN ELECTRONIC TEST CIRCUIT

BACKGROUND

1. Technical Field

The present disclosure relates to a speaker device of the MEMS (microelectromechanical systems) type, which includes an electronic test circuit. In addition, the present disclosure relates to a corresponding method for testing the speaker device.

2. Description of the Related Art

As is shown, for example, in FIG. 1, a MEMS speaker 1 comprises a plurality of membranes 2, which are arranged so as to form a planar array. For example, the MEMS speaker 1 is formed by 1024 membranes, which are arranged on thirty-two rows and thirty-two columns.

The MEMS speaker 1 further comprises, for each column, a top electrode T and a bottom electrode B, as well as a top-electrode driving circuit 4 and a bottom-electrode driving circuit 6.

The top-electrode driving circuit 4 is electrically arranged between a first supply node, which is set at a first supply voltage $V_D$, and ground. In addition, the top-electrode driving circuit 4 has an input terminal $IN_T$ and an output terminal, the latter being connected to the top electrode T.

Operatively, the top-electrode driving circuit 4 is designed to impose the voltage on the top electrode T, in such a way that the latter is substantially close to the first supply voltage $V_D$, or else is substantially zero, according to the voltage present on the input terminal $IN_T$. In either case, the output terminal of the top-electrode driving circuit 4 is at low impedance, substantially zero.

The bottom-electrode driving circuit 6 is electrically arranged between the first supply node and ground. Moreover, the bottom-electrode driving circuit 6 has an input terminal $IN_B$ and an output terminal, the latter being connected to the bottom electrode B.

Operatively, the bottom-electrode driving circuit 6 is designed to impose the voltage on the bottom electrode B, in such a way that the latter is substantially close to the first supply voltage $V_D$, or else is substantially zero, according to the voltage present on the input terminal $IN_B$. In either case, the output terminal of the bottom-electrode driving circuit 6 is at low impedance, substantially zero.

The MEMS speaker 1 further comprises, for each row, a membrane electrode M, which is connected to all the membranes 2 of the row. In addition, the MEMS speaker 1 comprises, for each row, a membrane-electrode driving circuit 8.

Each membrane-electrode driving circuit 8 is electrically arranged between a second supply node, which is set at a second supply voltage $V_{D2}$, and the first supply node. The second supply voltage $V_{D2}$ is higher than the first supply voltage $V_D$; for example, the second supply voltage $V_{D2}$ is twice the first supply voltage $V_D$. Moreover, the membrane-electrode driving circuit 8 has an input terminal $IN_M$ and an output terminal, the latter being connected to the membrane electrode M.

Operatively, the membrane-electrode driving circuit 8 is designed to impose the voltage on the membrane electrode M in such a way that the latter is substantially close, alternatively, to the first supply voltage $V_D$ or else to the second supply voltage $V_{D2}$, according to the voltage present on the input terminal $N_M$. In either case, the output terminal of the membrane-electrode driving circuit 8 is at low impedance, substantially zero.

From a mechanical standpoint, the MEMS speaker 1 is formed in a body of semiconductor material, which comprises a substrate 9 (FIG. 2). The top electrodes T and the bottom electrodes B are fixed with respect to the substrate 9.

As shown in FIG. 2, each top electrode T is formed by a plurality of top-electrode subregions SRT, each of which overlies, at a distance, a corresponding membrane 2. The top-electrode subregions SRT of each column are in ohmic contact with one another so as to form precisely the top electrode T. Moreover, each top-electrode subregion SRT is made, for example, of metal and is hollow so as to enable passage of air. The top-electrode subregions SRT are also known as "top plates".

Each bottom electrode B is formed by a plurality of bottom-electrode subregions SRB, each of which is arranged underneath a corresponding membrane 2, at a distance from the latter. The bottom-electrode subregions SRB of each column are in ohmic contact with one another so as to form precisely the bottom electrode B. Moreover, each bottom-electrode subregion SRB is made, for example, of metal and is hollow so as to enable passage of air. The bottom-electrode subregions SRB are also known as "bottom plates".

In practice, each top electrode T overlies, at a distance, the membranes 2 of the column corresponding thereto, which in turn overly, at a distance, the bottom electrode B of this column. Moreover, each bottom electrode B overlies the substrate 9.

Each membrane 2 forms, together with the corresponding top electrode T and with the corresponding bottom electrode B, and in particular together with the corresponding top plate SRT and the corresponding bottom plate SRB, an elementary unit 10, which is also known as "pixel 10". Moreover, each membrane 2 is mobile with respect to the corresponding top plate SRT and to the corresponding bottom plate SRB, and hence is mobile with respect to the bottom electrode B and to the top electrode T of its own column. For this purpose, each membrane 2 is connected to the corresponding membrane electrode M through a first spring 11 and a second spring 13 in such a way that the membrane 2 can move vertically with respect to fixed portions of the membrane electrode M to which it is connected.

In use, the voltages of the bottom and top electrodes B, T and of the membrane electrodes M are set in such a way that the membranes 2 are subject to electrostatic forces that cause movement thereof in the vertical direction, alternatively towards the corresponding top plates SRT, or else towards the corresponding bottom plates SRB.

In particular, the movement of each membrane 2 is such that it approaches alternatively the corresponding top plate SRT or the corresponding bottom plate SRB, without, however, contacting any of them in order to prevent short circuiting.

In order to prevent short circuiting, present in each pixel 10 are one or more top spacer elements 14, also known as "top dimples", and one or more bottom spacer elements 16, also known as "bottom dimples". In particular, in the example shown in FIG. 2, each top plate SRT is associated to a corresponding top dimple 14, which is fixed with respect to the top plate SRT and is arranged between the top plate SRT and the corresponding membrane 2. Moreover, each bottom plate SRB is associated to a corresponding bottom dimple 16, which is fixed with respect to this bottom plate SRB and is arranged between the bottom plate SRB and the corresponding membrane 2.

In practice, each membrane 2 is mobile between i) a first position, in which it is in contact with the bottom dimple 16 of the corresponding bottom plate SRB, and is set at a distance from the top dimple 14 of the corresponding top plate SRT, and ii) a second position, in which it is in contact with the top dimple 14 of the corresponding top plate SRT, and is set at a distance from the bottom dimple 16 of the corresponding bottom plate SRB.

In use, each membrane 2 is hence made to oscillate between the aforementioned first and second positions, in such a way that each pixel 10 generates an acoustic wave, which can be perceived by a listener. In practice, each pixel 10 is able to transduce electrical signals into a respective elementary acoustic wave, the ensemble of the elementary acoustic waves generated by the pixels 10 forming the acoustic wave as a whole emitted by the MEMS speaker 1.

Considering, for example, a single pixel 10, the movement of the respective membrane 2 can be obtained by applying to this membrane 2, to the corresponding top plate SRT, and to the corresponding bottom plate SRB, and hence, respectively, to the corresponding membrane electrode M, to the corresponding top electrode T, and to the corresponding bottom electrode B, the voltages shown in FIG. 3.

For greater clarity, in FIG. 3 it is assumed that the first and second supply voltages $V_D$, $V_{D2}$ are respectively equal to 25 V and 50 V. Moreover, it is assumed that the membrane 2 is initially latched to the bottom plate SRB, i.e., that it is in the aforementioned first position and that the voltages on the corresponding top electrode T, on the corresponding membrane electrode M, and on the corresponding bottom electrode B are such that, in the absence of variations of voltage, the membrane 2 remains in the first position. For example, it is assumed that the voltages on this top electrode T, on this membrane electrode M, and on this bottom electrode B are, respectively, equal to 0 V, 50 V and 0 V. In this way, in the absence of voltage variations, the membrane 2 remains latched to the bottom plate SRB, thanks to the considerable force of electrostatic attraction present between the membrane 2 and the bottom plate SRB, which exceeds the force of electrostatic attraction present between this membrane 2 and the corresponding top plate SRT. This is due to the fact that, even though the voltage present between the membrane 2 and the corresponding bottom plate SRB is equal to the voltage present between the membrane 2 and the corresponding top plate SRT, the membrane 2 is closer to the corresponding bottom plate SRB than to the corresponding top plate SRT.

This being said, while the voltage on the top electrode T is kept at zero, the voltage on the membrane electrode M is reduced to 25 V, and simultaneously the voltage on the bottom electrode B is raised to 25 V. In this way, the voltage present between the membrane 2 and the corresponding bottom plate SRB vanishes, and consequently the force of electrostatic attraction present between them vanishes. The membrane 2 hence tends to move vertically in the direction of the corresponding top plate SRT, on account of the voltage difference present between the membrane 2 and the corresponding top plate SRT. Next, after the membrane 2 has moved away from the corresponding bottom plate SRB by a distance greater than a distance known as "critical distance", the voltage on the membrane electrode M is raised to 50 V, whereas the voltage on the bottom electrode B is reduced to 0 V; instead, the voltage on the top electrode T is kept at zero. In this way, the membrane 2 is latched to the top plate SRB. It should be noted how by "latching of a membrane to a plate", whether top or bottom, is generally meant the fact that this plate is effectively the plate that corresponds to the membrane, i.e., overlies the membrane, or else is overlaid by the membrane, with respect to which it is to a first approximation aligned.

Next, in order to latch again the membrane 2 to the bottom plate SRB, the voltage on the membrane electrode M is reduced to 25 V, and simultaneously the voltage on the top electrode T is raised to 25 V. By so doing, the membrane 2 tends to move vertically in the direction of the corresponding bottom plate SRB, on account of the voltage difference present between the membrane 2 and the corresponding bottom plate SRB. Next, after the membrane 2 is at a distance from the bottom electrode B lower than the critical distance, the voltage on the membrane electrode M is raised to 50 V, whereas the voltage on the top electrode T is reduced to 0 V; instead, the voltage on the bottom electrode B is kept at zero.

In this way, the membrane 2 is latched to the bottom plate SRB.

In greater detail, the membranes 2 are actuated by a control unit 15, which is connected at output to the input terminals $IN_T$ of the top-electrode driving circuits 4, to the input terminals $IN_B$ of the bottom-electrode driving circuits 6, and to the input terminals $IN_M$ of the membrane-electrode driving circuits 8.

The control unit 15 receives at input a clock signal CLK and a frame signal LATCH, which has a frequency equal to one thirty-second of the frequency of the clock signal CLK. In this way, the control unit 15 defines a succession of frames, each of which is formed by thirty-two bits.

The control unit 15 moreover receives a first control signal ROW, a second control signal CTOP and a third control signal CBOT, each of which defines, for each frame, thirty-two bits. These first, second, and third control signals ROW, CTOP, and CBOT hence enable indexing, at each frame, of all the pixels 10 of the MEMS speaker 1. In fact, each bit of the first control signal ROW is associated to a corresponding membrane electrode M, while each bit of the second control signal CTOP is associated to a corresponding top electrode T, and each bit of the third control signal CBOT is associated to a corresponding bottom electrode B.

The clock signal CLK, the frame signal LATCH, and the first, second, and third control signals ROW, CTOP and CBOT can be generated, for example, by an external electronic unit (not shown).

As shown in FIG. 4, the control unit 15 processes the clock signal CLK, the frame signal LATCH, and the first, second, and third control signals ROW, CTOP and CBOT so as to generate corresponding voltages on the input terminals $IN_T$ of the top-electrode driving circuits 4, on the input terminals $IN_B$ of the bottom-electrode driving circuits 6, and on the input terminals $IN_M$ of the membrane-electrode driving circuits 8.

For example, FIG. 4 shows three successive frames, with particular reference to an example pixel, which is associated to the second bit (BIT1) of the first control signal ROW and to the third bit (BIT2) of the second and third control signals CTOP, CBOT, i.e., with particular reference to the pixel the membrane of which i) is connected to the membrane electrode M associated to the second bit of the first control signal ROW, ii) is overlaid by the top plate SRT connected to the top electrode T associated to the third bit of the second control signal CTOP, and iii) overlies the bottom plate SRB connected to the bottom electrode B associated to the third bit of the third control signal CBOT. Moreover, FIG. 4 shows the plots of the voltages $V_{ROW1}$, $V_{CTOP2}$ and $V_{CBOT2}$, which are respectively the voltages of the membrane electrode M and of the top electrode T and bottom electrode B corresponding to the example pixel. In addition, in FIG. 4 it is assumed that, during the first frame, the membrane of the example pixel is latched to the bottom plate.

This being said, as regards the first frame, the second bit of the first control signal ROW and the third bit of the second control signal CTOP are at low logic values, while the third bit of the second control signal CTOP is at a high logic value. This implies that, during the second frame, the voltage $V_{ROW1}$ is reduced to $V_D$, and the voltage $V_{CTOP2}$ is kept at zero, while the voltage $V_{CBOT2}$ is raised to $V_D$.

During the second frame, the second bit of the first control signal ROW is at a high logic value, while the third bits of the second and third control signals CTOP, CBOT are at low logic values. Consequently, during the third frame, the voltage $V_{ROW1}$ is raised again to $V_{D2}$, and the voltage $V_{CTOP2}$ is kept at zero, while the voltage $V_{CBOT2}$ is set at zero. In this way, in the time that elapses between the three frames shown in FIG. 4, the membrane of the example pixel is brought, starting from the condition of latching to the bottom plate, to the condition of latching to the top plate.

Irrespective of the details regarding the modalities of control of the MEMS speaker 1, there is room to improve the manufacture, or in any case integrity, of the MEMS speaker 1. In particular, testing, given any pixel 10, the capacity of the corresponding membrane to latch to the corresponding top plate and/or to the corresponding bottom plate may be beneficial.

BRIEF SUMMARY

One embodiment of the present disclose provides a testing method to verify the integrity of at least one pixel of the MEMS speaker.

One embodiment of the present disclosure is directed to a MEMS speaker device that includes an elementary unit, said elementary unit including: a membrane, a top plate, and a bottom plate, the membrane being between the top plate and the bottom plate and configured to form a first capacitor and a second capacitor, with the top plate and with the bottom plate, respectively. The device includes an electronic driving circuit configured to operate, during a first operating period, to move the membrane into a first position, in which the membrane is closer to the bottom plate, and during a second operating period, to move the membrane into a second position, in which the membrane is closer to the top plate. The device also includes an electronic test circuit that includes: a first measuring circuit configured to generate a first measurement signal based on a capacitance of one of the first and second capacitors, after the first operating period, said first measuring circuit being configured to generate a second measurement signal based on the capacitance of one of the first and second capacitors, after the second operating period, and a first comparator circuit configured to compare said first and second measurement signals with at least one first electrical reference quantity, to detect a mobility of the membrane in a direction of the top plate or the bottom plate, based on the comparison.

BRIEF DESCRIPTION OF THE SEVERAL VIEWS OF THE DRAWINGS

According to the present disclosure a MEMS speaker device and a testing method are hence provided.

For a better understanding of the present disclosure preferred embodiments are now described, purely by way of non-limiting examples, with reference to the attached drawings, in which.

DETAILED DESCRIPTION

Figure 1:
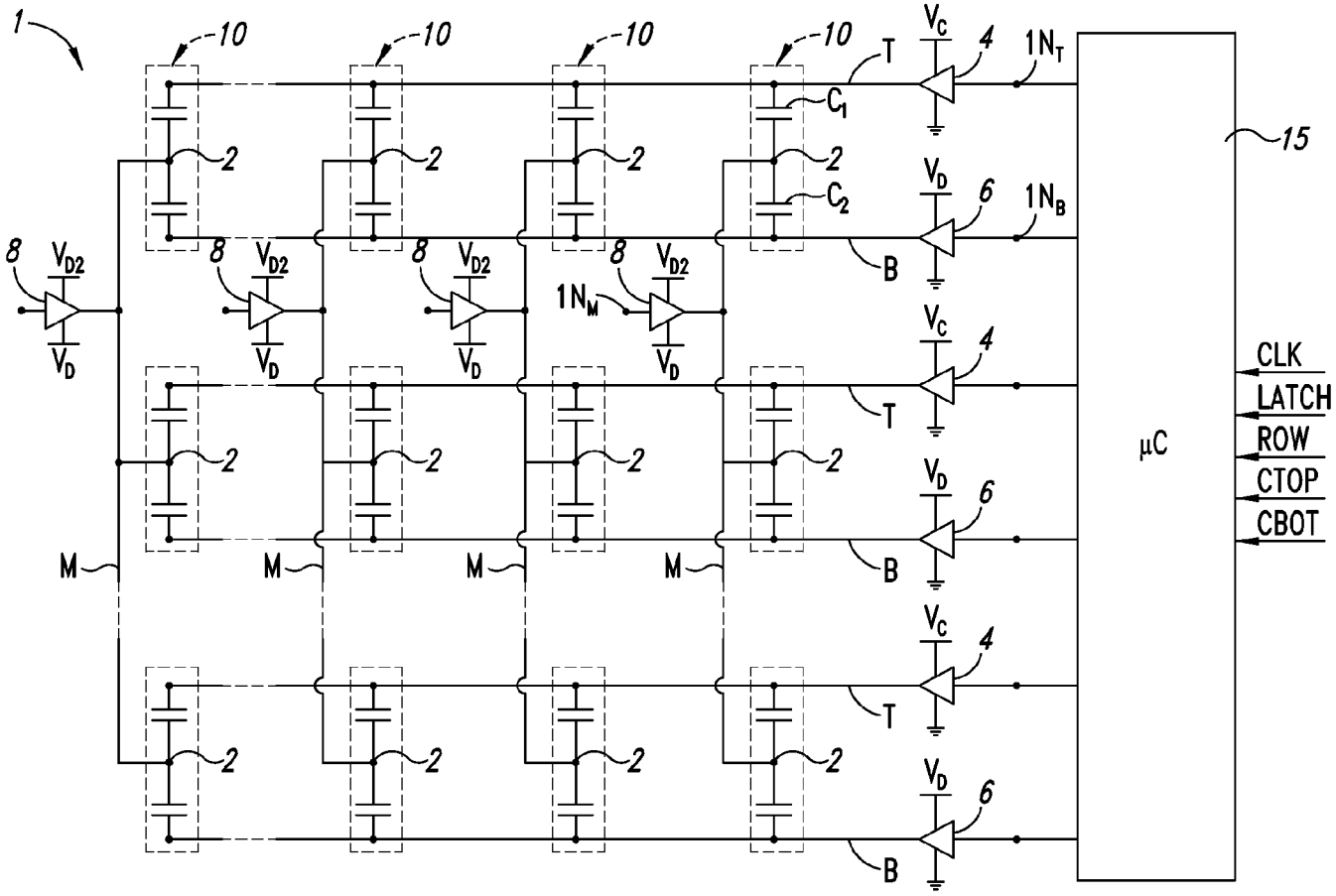
FIG. 1 (Prior Art)
FIG. 1 shows an equivalent electrical circuit of a portion of a MEMS speaker of a known type.
Figure 2:
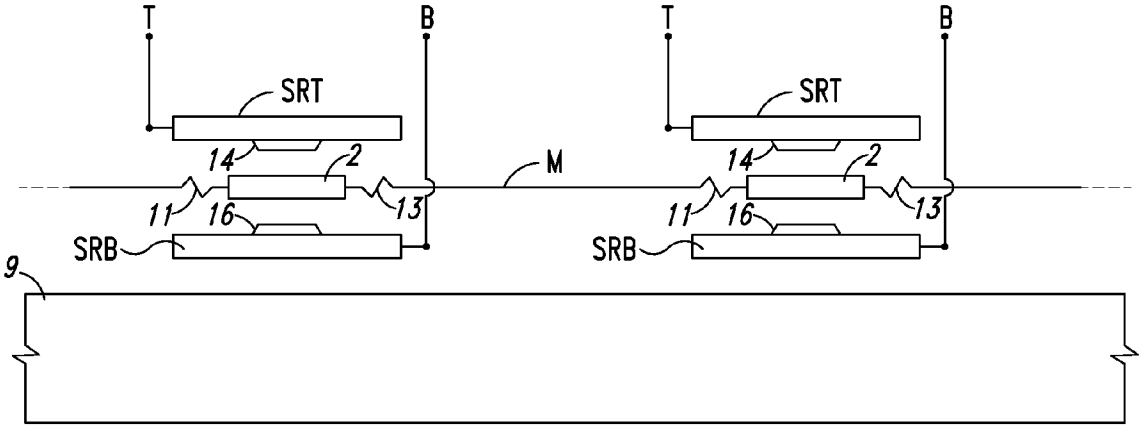
FIG. 2 (Prior Art)
FIG. 2 shows schematically cross sections of two pixels of the MEMS speaker shown in FIG. 1.
Figure 3:
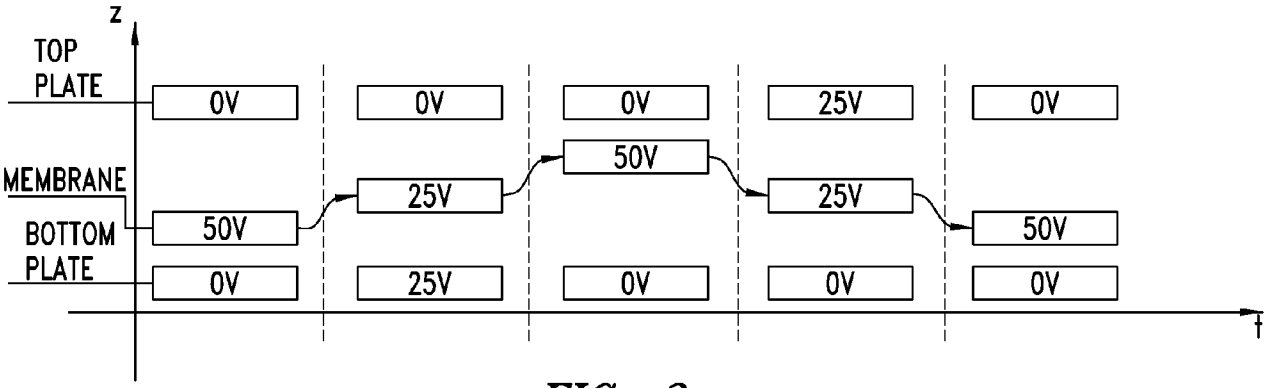
FIG. 3 (Prior Art)
FIG. 3 shows a diagram that gives, on a first axis, a time co-ordinate (t) and, on a second axis, a space co-ordinate (z), this diagram showing the evolution in time of the position of the membrane of a pixel, as well as the evolution in time of the voltages of the top plate, of the bottom plate, and of the membrane of this pixel.
Figure 4:
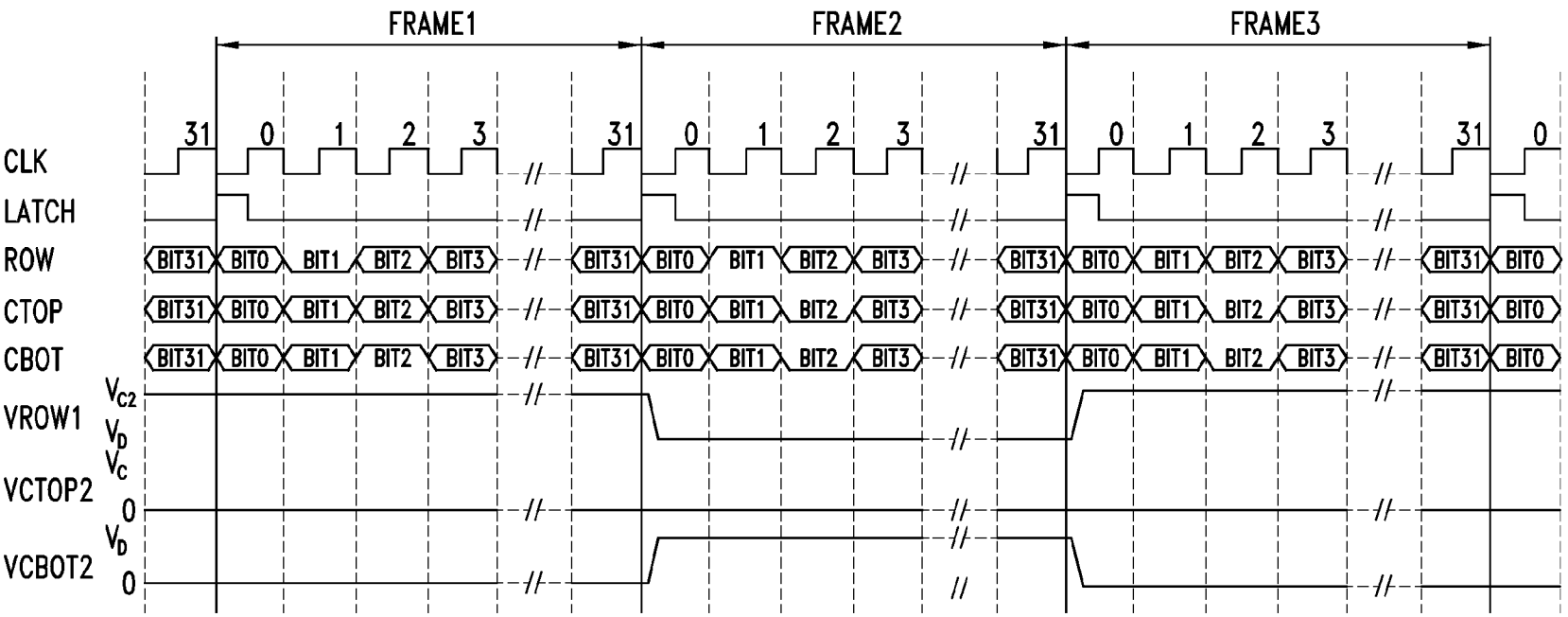
FIG. 4 (Prior Art)
FIG. 4 shows the evolution in time of electrical signals generated within a MEMS speaker.
Figure 5B:
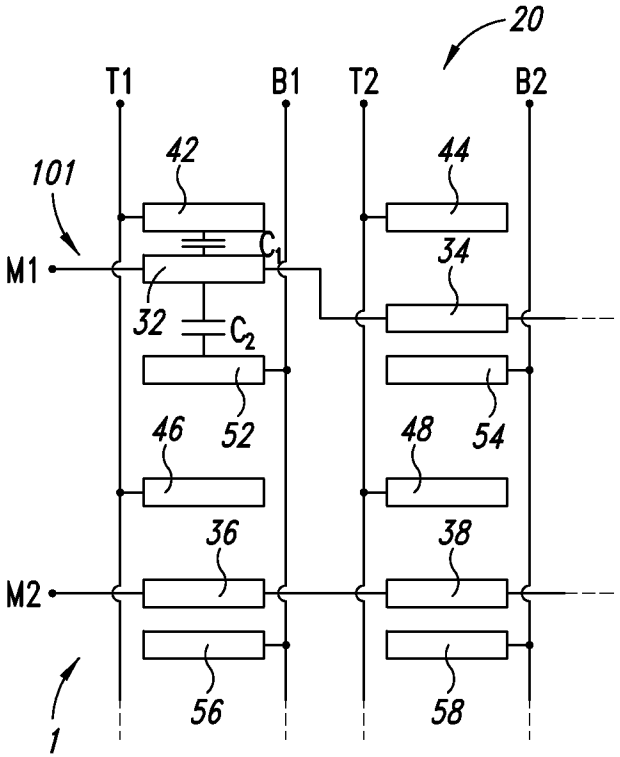
FIGS. 5*a* and 5*b* show schematically portions of a speaker device according to the present disclosure.
Figure 5A:
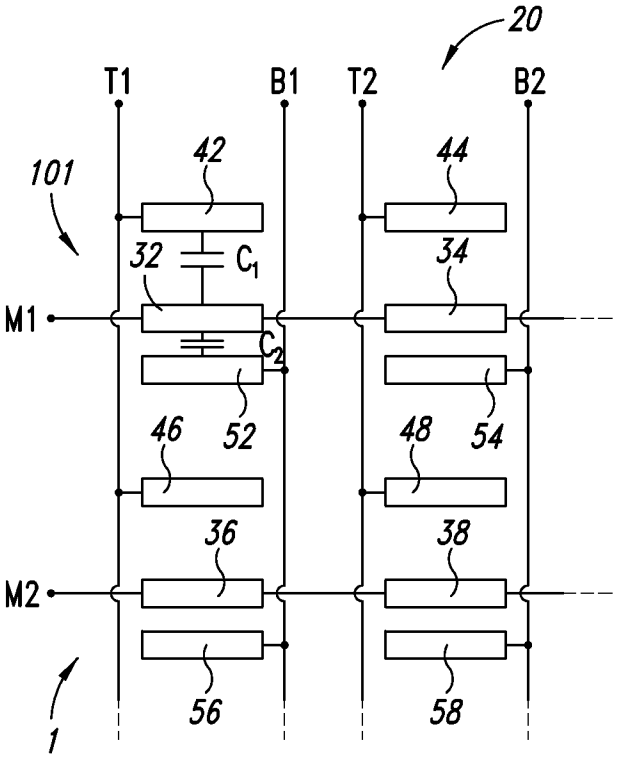

FIGS. 5*a* and 5*b* show a speaker device 20, which comprises the MEMS speaker 1 shown in FIG. 1. Components of the speaker device 20 already shown in FIG. 1 are designated by the same references, except where otherwise specified.

Moreover, the present description focuses primarily on the differences between the speaker device 20 and the MEMS speaker 1.

Purely by way of example, each of FIGS. 5*a* and 5*b* shows a first membrane 32, a second membrane 34, a third membrane 36, and a fourth membrane 38. The first and second membranes 32, 34 belong to a first row of the MEMS speaker 1, and are hence connected together, as well as to a first membrane electrode M1; the third and fourth membranes 36, 38 belong, instead, to a second row, and are hence connected together, as well as to a second membrane electrode M2.

More in particular, the first membrane 32 is arranged between a first top plate 42 and a first bottom plate 52, at a distance therefrom, these plates forming, respectively, a first top electrode T1 and a first bottom electrode B1.

The second membrane 34 is arranged between a second top plate 44 and a second bottom plate 54, at a distance therefrom, these plates forming, respectively, a second top electrode T2 and a second bottom electrode B2.

The third membrane 36 is arranged between a third top plate 46 and a third bottom plate 56, at a distance therefrom, these plates forming, respectively, the first top electrode T1 and the first bottom electrode B1.

The fourth membrane 38 is arranged between a fourth top plate 48 and a fourth bottom plate 58, at a distance therefrom, these plates forming, respectively, the second top electrode T2 and the second bottom electrode B2.

Figure 6:
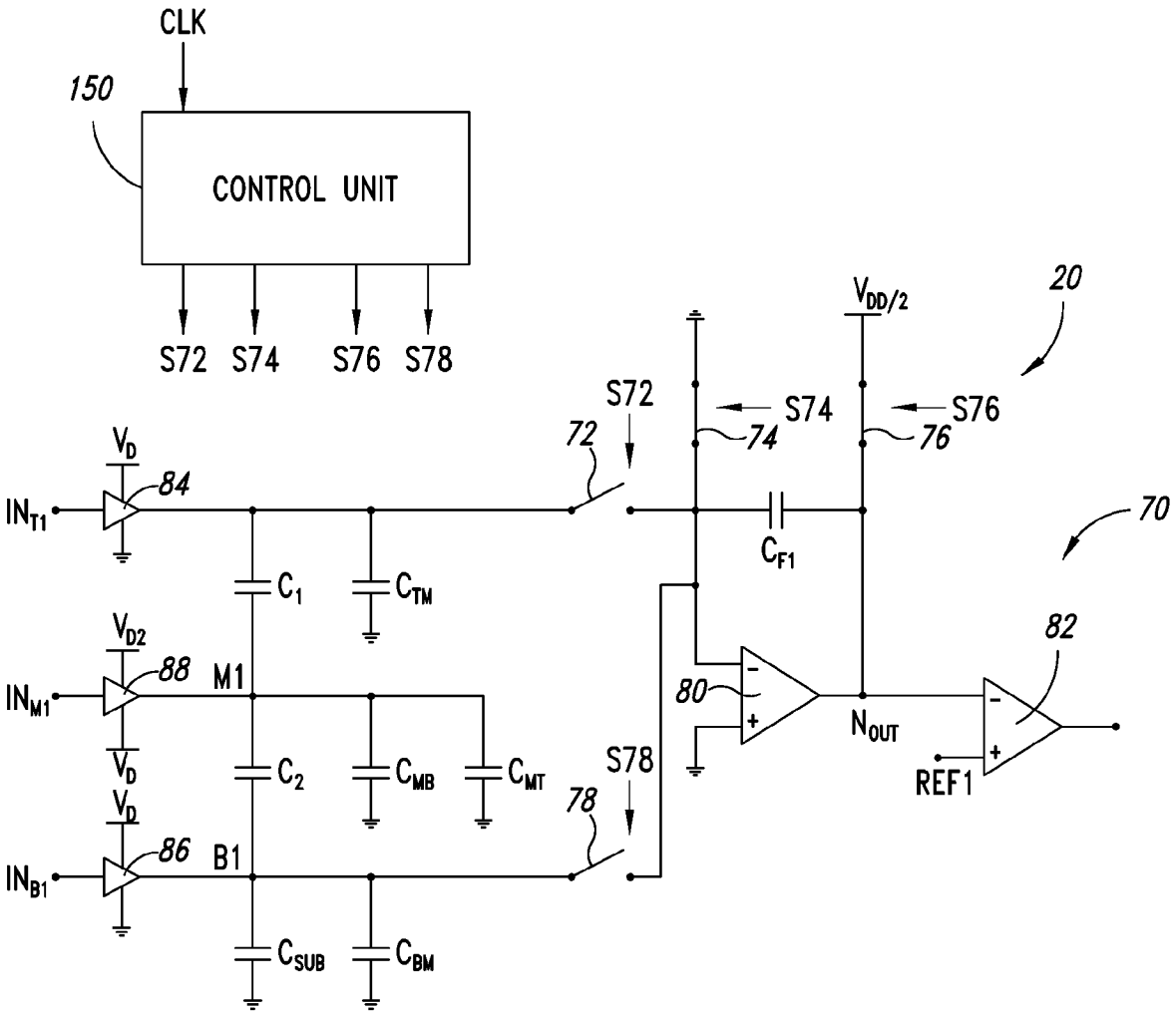
FIG. 6 shows an equivalent electrical circuit of a portion of the speaker device shown in FIGS. 5*a* and 5*b*, during a first operating step.

This being said, according to a first embodiment, shown in FIG. 6, the speaker device 20 comprises a testing circuit 70, which include a first switch 72, a second switch 74, a third switch 76, and a fourth switch 78, as well as a detection capacitor $C_{F1}$ and a first differential amplifier 80 and a second differential amplifier 82. Moreover shown in FIG. 6 are the first membrane electrode M1, the first top electrode T1, and the first bottom electrode B1. FIG. 6 moreover shows a first top-electrode driving circuit 84, a first bottom-electrode driving circuit 86, and a first membrane-electrode driving circuit 88, these output terminals being, respectively, connected to the first top electrode T1, to the first bottom electrode B1, and to the first membrane electrode M1. The input terminals of the first top-electrode driving circuit 84, of the first bottom-electrode driving circuit 86, and of the first membrane-electrode driving circuit 88 are, respectively, designated by $IN_{T1}$, $IN_{B1}$ and $IN_{M1}$.

The testing circuit 70 is common to all the pixels 10 of the speaker device 20. In particular, the second and third switches 74, 78, the detection capacitor $C_{F1}$ and the first and second differential amplifiers 80, 82 are shared between all the pixels 10 of the MEMS speaker 1. To each pixel 10 there corresponds, instead, a pair of respective switches, which will be referred to also as "pixel switches"; given a pixel, one between the two pixel switches is arranged between the top electrode T corresponding to this pixel and the negative input terminal of the first differential amplifier 80, whereas the other is arranged between the bottom electrode B corresponding to this pixel and the negative input terminal of the first differential amplifier 80.

As shown once again in FIG. 6, present between the first top electrode T1 and the first membrane electrode M1 is a first capacitor $C_1$, whilst present between the first membrane electrode M1 and the first bottom electrode B1 is a second capacitor $C_2$. In practice, the plates of the first capacitor $C_1$ are formed, respectively, by the first top plate 42 and by the first membrane 32, whereas the plates of the second capacitor $C_2$ are formed, respectively, by the first membrane 32 and by the first bottom plate 52.

Between the first top electrode T1 and ground a third capacitor $C_{TM}$ is moreover present, the capacitance of which is equal to the summation of the capacitances of the capacitors formed by the first top electrode T1 and, respectively, by the membranes other than the first membrane 32 and belonging to the same column to which the first membrane 32 belongs.

Moreover present between the first membrane electrode M1 and ground are a fourth capacitor $C_{MB}$ and a fifth capacitor $C_{MT}$. In particular, the capacitance of the fourth capacitor $C_{MB}$ is equal to the summation of the capacitances of the capacitors formed by the first membrane electrode M1 and, respectively, by the bottom plates SRB belonging to the columns other than the column to which the first membrane 32 belongs. The capacitance of the fifth capacitor $C_{MT}$ is equal to the summation of the capacitances of the capacitors formed by the first membrane electrode M1 and, respectively, by the top plates SRT belonging to the columns other than the column to which the first membrane 32 belongs.

Moreover present between the first bottom electrode B1 and ground are a sixth capacitor $C_{SUB}$ and a seventh capacitor $C_{BM}$. In particular, the capacitance of the sixth capacitor $C_{SUB}$ is equal to the capacitance of the capacitor formed by the first bottom electrode B1 and by the substrate 9; the capacitance of the seventh capacitor $C_{BM}$ is, instead, equal to the summation of the capacitances of the capacitors formed by the first bottom electrode B1 and, respectively, by the membranes other than the first membrane 32 and belonging to the same column to which the first membrane 32 belongs.

Once again with reference to the testing circuit 70, as mentioned previously, the first switch 72 is connected between the first top electrode T1 and the negative input terminal of the first differential amplifier 80.

The second switch 74 is connected between ground and the negative input terminal of the first differential amplifier 80.

The third switch 76 is connected between the output terminal of the first differential amplifier 80 and a third supply node, which is set, in use, at a third supply voltage $V_{DD}/2$, which is, for example, of a few volts.

The fourth switch 78 is connected between the first bottom electrode B1 and the negative input terminal of the first differential amplifier 80.

The first, second, third, and fourth switches 72, 74, 76, 78 are controlled by a control unit 150, as described hereinafter. The control unit receives at least a clock signal CLK and provides control signals S72, S74, S76, S78 for the first, second, third, and fourth switches 72, 74, 76, 78. Moreover, the detection capacitor $C_{F1}$ is connected between the negative input terminal and the output terminal of the first differential amplifier 80 so as to feedback the latter. The positive input terminal of the first differential amplifier 80 is connected to ground.

The negative input terminal of the second differential amplifier 82 is connected to the output terminal of the first differential amplifier 80, the latter output terminal defining a first output node $N_{OUT1}$, whereas the positive input terminal of the second differential amplifier 82 is set, in use, at a first reference voltage REF1. In practice, the second differential amplifier 82 functions as comparator.

The first membrane 32 belongs to a first pixel 101. To verify the integrity of this first pixel 101, and hence correct mobility of the first membrane 32, it is possible to carry out the operations described hereinafter.

Initially, at an instant $t_0$, the first and fourth switches 72, 78 are open, whereas the second and third switches 74, 76 are closed, as shown in FIG. 6. In this way, the detection capacitor $C_{F1}$ is charged to a voltage equal to the third supply voltage $V_{DD}/2$; consequently, the first differential amplifier 80 is biased in a corresponding working point.

Next, all the membranes are latched, in a way in itself known, to the corresponding bottom plates SRB. In other words, each membrane is closer to the corresponding bottom plate SRB than to the corresponding top plate SRT. With reference to the first membrane 32, it is set in the proximity of the first bottom plate 52, as shown for example in FIG. 5*a*. Purely by way of example, latching of the membranes is carried out between an instant $t_{BOT1}$ and an instant $t_{BOT2}$.

In this way, the speaker device 20 is controlled in a known state, irrespective of any state assumed by this speaker device 20 previously.

Next, at an instant $t_{HZ1}$, the first top-electrode driving circuit 84 is controlled, in a way in itself known, so as to operate in the so-called high-impedance mode. In other words, the output terminal of the first top-electrode driving circuit 84 is set at an ideally infinite impedance; hence, it is electrically uncoupled from the first top electrode T1.

Next, at an instant $t_{SW1}$, the first switch 72 is closed by the control unit 150.

Figure 7:
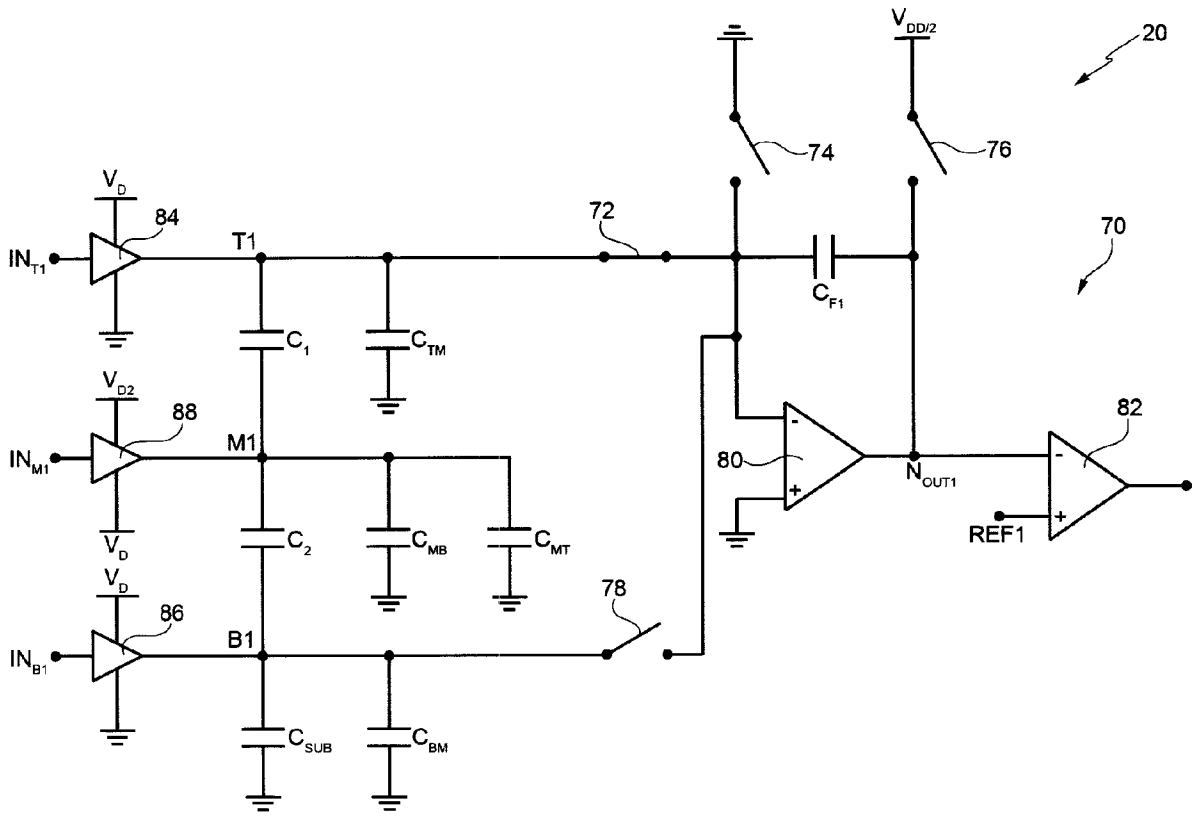
FIG. 7 shows the equivalent electrical circuit illustrated in FIG. 6, during a second operating step.

Then, at an instant $t_{SW2}$, the second and third switches 74, 76 are opened by the control unit 150, as shown in FIG. 7.

Figure 8:
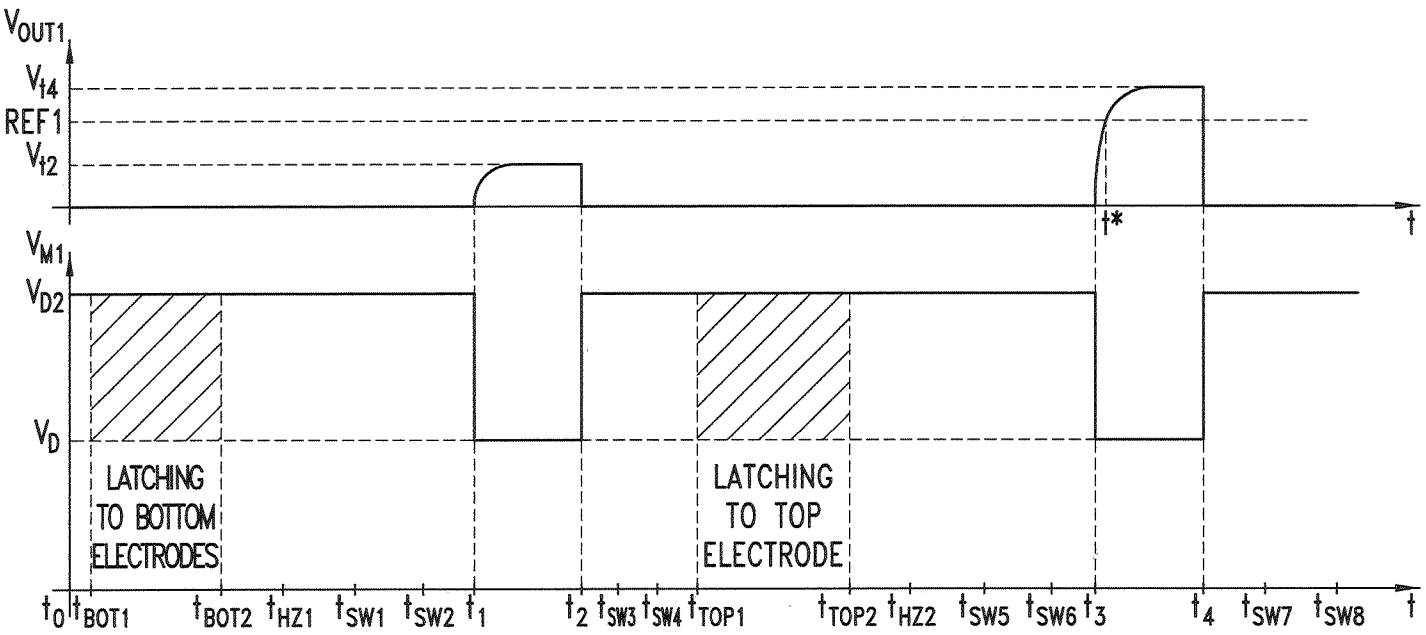
FIGS. 8 and 10 show time plots of electrical signals generated within the present speaker device.

The control unit 150 then applies a first stimulation signal to the input terminal $IN_{M1}$ of the first membrane-electrode driving circuit 88. The first stimulation signal is shown in FIG. 8, where the voltage on the input terminal $IN_{M1}$ is designated by $V_{M1}$.

The first stimulation signal is formed by a first falling edge, which takes place at an instant t1 and is followed by a first rising edge, which takes place at an instant $t_2$. The first falling edge extends between the second supply voltage $V_{D2}$ and the first supply voltage $V_D$, whereas the first rising edge extends between the first supply voltage $V_D$ and the second supply voltage $V_{D2}$. In addition, before the first falling edge, the input terminal $IN_{M1}$ of the first membrane-electrode driving circuit 88 is set at the second supply voltage $V_{D2}$, because the first membrane 32 has been previously latched to the first bottom plate 52. In this condition, the capacitance of the first capacitor $C_1$ is lower than the capacitance of the second capacitor $C_2$.

Since the first switch 72 is closed, and the second and third switches 74, 76 are open, in the time interval comprised between the instants $t_1$ and t2 the first differential amplifier 80 functions as inverting amplifier. More in particular, present on the first output node $N_{OUT1}$ is a first output voltage $V_{OUT1}$, which at the instant $t_1$ is equal to the third supply voltage $V_{DD}/2$, and then increases until it assumes, at the instant $t_2$, a value $V_{t2}$. In particular, the first output voltage $V_{OUT1}$ increases according to an exponential law, and moreover we have $V_{t2}=(V_{D2}-V_D)*C_1/C_{F1}$, where the capacitance of the first capacitor $C_1$ and of the detection capacitor $C_{F1}$ are designated by the references used for designating the corresponding capacitors (i.e., $C_1$ and $C_{F1}$).

Next, at an instant $t_{SW3}$, the second and third switches 74, 76 are closed so as to charge again the detection capacitor $C_{F1}$ to a voltage equal to the third supply voltage $V_{DD}/2$, maintaining the feedback of the first differential amplifier 80.

Next, at an instant $t_{SW4}$, the first switch 72 is opened.

Then, as shown in FIG. 5*b*, the first membrane 32 is latched to the first top plate 42, whereas the other membranes maintain the respective positions and hence remain latched to the corresponding bottom plates SRB.

Purely by way of example, the operations having the purpose of latching the first membrane 32 to the first top plate 42 occur in a time interval comprised between an instant $t_{TOP1}$ and a subsequent instant $t_{TOP2}$.

Next, at an instant $t_{HZ2}$, the first top-electrode driving circuit 84 is controlled, in a way in itself known, so as to operate in so-called high-impedance mode.

Next, at an instant $t_{SW5}$, the first switch 72 is closed.

Then, at an instant $t_{SW6}$, the second and third switches 74, 76 are opened.

The control unit 150 then applies a second stimulation signal to the input terminal $IN_{M1}$ of the first membrane-electrode driving circuit 88. In practice, the first and second stimulation signals form corresponding pulses. In addition, the first and second stimulation signals form a membrane driving signal, the latter being defined by the voltage $V_{M1}$ present on the input terminal $IN_{M1}$ of the first membrane-electrode driving circuit 88.

In detail, as shown once again in FIG. 8, the second stimulation signal is formed by a second falling edge, which occurs at an instant $t_3$ and is followed by a second rising edge, which occurs at an instant $t_4$. The second falling edge extends between the second supply voltage $V_{D2}$ and the first supply voltage $V_D$, whilst the second rising edge extends between the first supply voltage $V_D$ and the second supply voltage $V_{D2}$. Moreover, before the second falling edge, the input terminal $IN_{M1}$ of the first membrane-electrode driving circuit 88 is at the second supply voltage $V_{D2}$, because the first membrane 32 has been previously latched to the first top plate 42. In this condition, the capacitance of the first capacitor $C_1$ is higher than the capacitance of the second capacitor $C_2$.

Since the first switch 72 is closed, and the second and third switches 74, 76 (as well as the fourth switch 78) are open, in the time interval comprised between the instants $t_3$ and $t_4$ the first differential amplifier 80 functions as inverting amplifier. More in particular, at the instant $t_3$ the first output voltage $V_{OUT1}$ is equal to the third supply voltage $V_{DD}/2$, and then increases until it assumes, at the instant $t_4$, a value $V_{t4}$. In particular, the first output voltage $V_{OUT1}$ increases with an exponential law, and moreover we have $V_{t4}=(V_{D2}-V_D)*C_1/C_{F1}$. Since, in the time interval comprised between the instants $t_3$ and $t_4$, the capacitance of the first capacitor $C_1$ is higher than the capacitance that this first capacitor $C_1$ has during the time interval comprised between the instants $t_1$ and $t_2$, the relation $V_{t4}>V_{t2}$ applies.

Next, at an instant $t_{SW7}$, the second and third switches 74, 76 are closed. Finally, at an instant $t_{SW8}$, the first switch 72 is opened.

In greater detail, the first reference voltage REF1 is set in a way in itself known, on the basis of the expected deflection of the first membrane 32, and hence of the corresponding expected values of the capacitance of the first capacitor $C_1$, in relation to the cases where the first membrane 32 is latched, respectively, to the first bottom plate 52 and to the first top plate 42, and on the hypothesis that the first membrane 32 is in fact mobile according to the design of the MEMS speaker 1.

The first reference voltage REF1 is hence set in such a way that, in the case where the pixel 101 containing the first membrane 32 is intact, it is comprised between $V_{t2}$ and $V_{t4}$. It hence follows that, in the case where the pixel 101 is intact, the first output voltage $V_{OUT1}$ respects a first condition.

In particular, the first condition envisages that, considering the time interval comprised between the instants $t_1$ and $t_2$ and the time interval comprised between the instants $t_3$ and $t_4$, the first output voltage $V_{OUT1}$ exceeds the first reference voltage REF1 only in a subinterval of the time interval comprised between the instants $t_3$ and $t_4$, and in particular in the interval comprised between an instant t* and the instant $t_4$. Equivalently, the first condition envisages that $V_{t2}<REF1<V_{t4}$.

In what follows, for brevity, by "inspection time window" is meant the union of the time interval comprised between the instants $t_1$ and $t_2$ and of the time interval comprised between the instants $t_3$ and $t_4$.

If the pixel 101 is intact, during the inspection time window the voltage of the output terminal of the second differential amplifier 82 is normally positive and has a negative peak only in the subinterval comprised between the instants t* and $t_4$. It follows that, if by "analysis signal" is meant the signal present on the output terminal of the second differential amplifier 82, it is possible to verify respect of the aforementioned first condition, and hence integrity of the pixel 101, on the basis of the values assumed of the analysis signal.

In particular, in the case where the analysis signal is positive during the time interval comprised between the instants $t_1$ and $t_2$, and negative only during the subinterval [t*, $t_4$], it is possible to infer that the pixel 101 is intact, at least as regards the capacity of the first membrane 32 to latch to the first top plate 42. The second differential amplifier 82 hence functions as detection unit.

The analysis described is hence based on the generation of a signal proportional to the capacitance of the first capacitor $C_1$, which makes it possible to verify that this first capacitor $C_1$ assumes the expected values of capacitance for the conditions of latching to the first top plate 42 and the first bottom plate 52. In other words, the operations performed between the instant $t_{HZ1}$ and the instant $t_2$ enable measurement of the capacitance of the first capacitor $C_1$, when the first membrane 32 is latched to the first bottom plate 52, or rather, more precisely, when the first membrane 32 should be latched to the first bottom plate 52, in the case of intact pixel.

Moreover, the operations performed between the instant $t_{HZ2}$ and the instant $t_4$ enable measurement of the capacitance of the first capacitor $C_1$, when the first membrane 32 is latched to the first top plate 42, or rather, more precisely, when the first membrane 32 should be latched to the first top plate 42, in the case of intact pixel. For practical purposes, the plots of the first output voltage $V_{OUT1}$ during the intervals $[t_1, t_2]$ and $[t_3, t_4]$ form corresponding signals of measurement.

In what follows, for brevity, the ensemble of the operations described previously will be referred to as "operations of detection of the capacitance of the first capacitor $C_1$".

In addition, or else as an alternative, to the aforementioned operations of detection of the capacitance of the first capacitor $C_1$, it is possible to carry out operations of detection of the capacitance of the second capacitor $C_2$.

In detail, the operations of detection of the capacitance of the second capacitor $C_2$ are similar to the operations of detection of the capacitance of the first capacitor $C_1$, except for the following differences:

- at the instant $t_{HZ1}$, the control unit 150 controls, instead of the first top-electrode driving circuit 84, the first bottom-electrode driving circuit 86, in such a way that will operate in high-impedance mode;
- at the instant $t_{SW1}$, instead of the first switch 72, the fourth switch 78 is closed;
- at the instant $t_{SW4}$, instead of the first switch 72, the fourth switch 78 is opened;
- at the instant $t_{HZ2}$, the control unit 150 controls, instead of the first top-electrode driving circuit 84, the first bottom-electrode driving circuit 86, in such a way that will operate in high-impedance mode;
- at the instant $t_{SW5}$, instead of the first switch 72, the fourth switch 78 is closed; and
- at the instant $t_{SW8}$, instead of the first switch 72, the fourth switch 78 is opened.

Moreover, in the case of detection of the capacitance of the second capacitor $C_2$, the evolution of the first output voltage $V_{OUT1}$ in the interval comprised between the instants $t_1$ and $t_2$ and in the interval comprised between the instants $t_3$ and $t_4$ is reversed with respect to what shown in FIG. 8. We thus find that, in the case where the pixel 101 is intact, the relation $V_{t2}>V_{t4}$ applies.

It follows that, in the case where the pixel 101 is intact, the first output voltage $V_{OUT1}$ respects a second condition. In particular, the second condition envisages that, considering the inspection time window, the first output voltage $V_{OUT1}$ exceeds the first reference voltage REF 1 only in a subinterval (not shown) of the time interval comprised between the instants $t_1$ and $t_2$. Consequently, if the pixel 101 is intact, during the inspection time window the voltage of the output terminal of the second differential amplifier 82 is normally positive and has a negative peak only in the aforementioned subinterval of the time interval comprised between the instants $t_1$ and $t_2$. It follows that, in the case where the analysis signal is positive during the time interval comprised between the instants $t_3$ and $t_4$, and negative only during the aforementioned subinterval of the time interval comprised between the instants $t_1$ and $t_2$, it may be inferred that the pixel 101 is intact, at least as regards the capacity of the first membrane 32 to latch to the first bottom plate 52.

In practice, the operations of detection of the capacitance of the second capacitor $C_2$ are based on the generation of a signal proportional to the capacitance of the second capacitor $C_2$, which makes it possible to verify that this second capacitor $C_2$ assumes the expected values of capacitance for the conditions of latching to the first top plate 42 and the first bottom plate 52.

In other words, the operations performed between the instant $t_{HZ1}$ and the instant $t_2$ enable measurement of the capacitance of the second capacitor $C_2$, when the first membrane 32 is latched to the first bottom plate 52, or rather, more precisely, when the first membrane 32 should be latched to the first bottom plate 52, in the case of intact pixel. Moreover, the operations performed between the instant $t_{HZ2}$ and the instant $t_4$ enable measurement of the capacitance of the second capacitor $C_2$, when the first membrane 32 is latched to the first top plate 42, or rather, more precisely, when the first membrane 32 should be latched to the first top plate 42, in the case of intact pixel. For the practical purposes, the plots of the first output voltage $V_{OUT1}$ during the intervals $[t_1, t_2]$ and $[t_3, t_4]$ once again form corresponding measurement signals.

It should moreover be noted how the first reference voltage REF1 is not modified in the case where it is presumed that, should the pixel 101 be intact, the values of the capacitance of the second capacitor $C_2$ in conditions of latching of the first membrane 32 to the first bottom plate 52 and to the first top plate 42 are substantially equal, respectively, to the values of the capacitance of the first capacitor $C_1$ in conditions of latching to the first top plate 42 and to the first bottom plate 52.

Iterating the operations of detection of the capacitance of the first capacitor $C_1$ and/or the operations of detection of the capacitance of the second capacitor $C_2$ on all the pixels 10, the entire MEMS speaker 1 is tested.

Moreover, for the reasons described previously, for each pixel 101 it is possible to test the first capacitor $C_1$ and/or the second capacitor $C_2$. During these operations, it is found that not more than one pixel switch is closed at a time.

Figure 9:
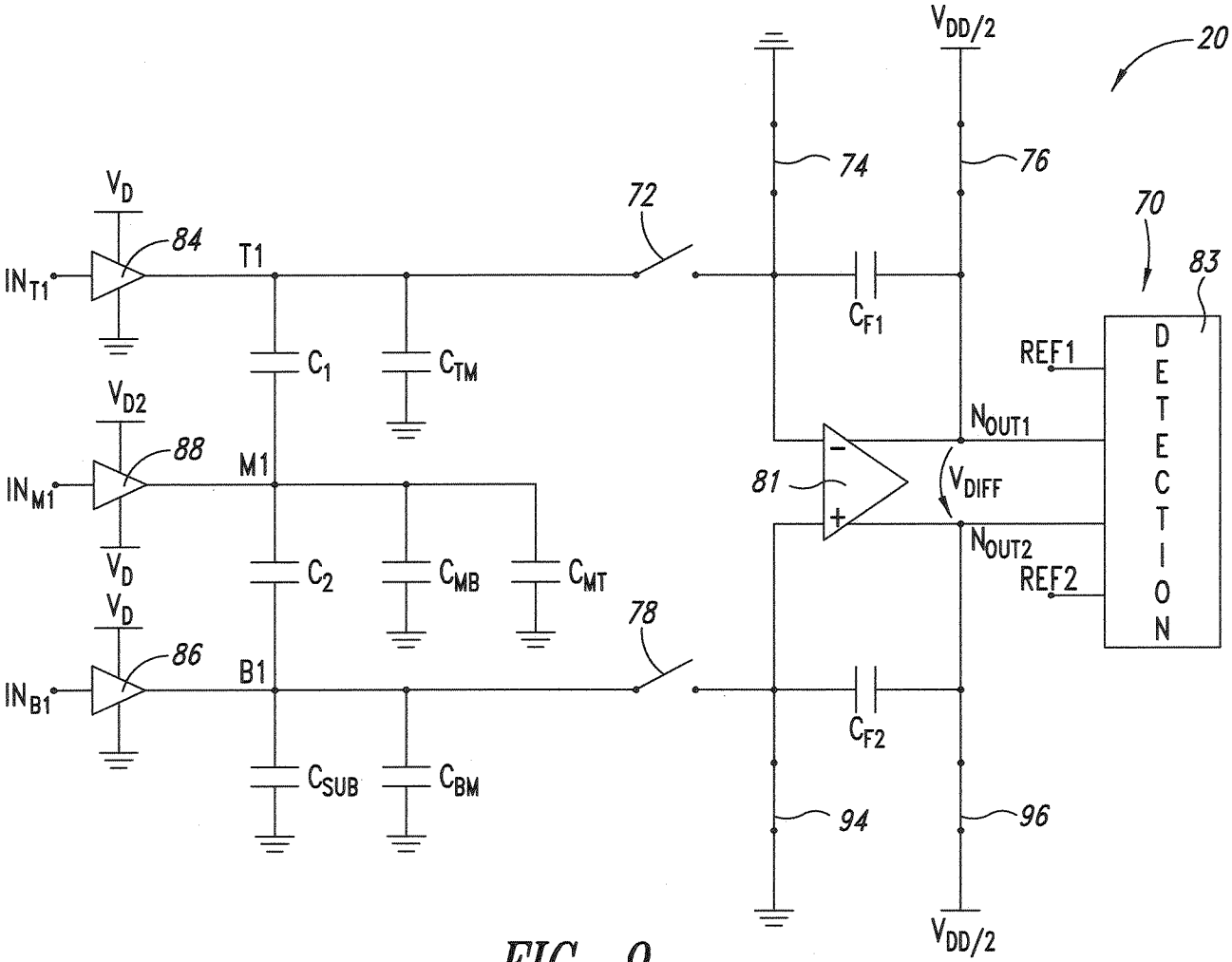
FIG. 9 shows an equivalent electrical circuit of a different embodiment of the present speaker device.

According to a different embodiment, shown in FIG. 9, the fourth switch 78 is arranged between the first bottom electrode B1 and the positive input terminal of the first differential amplifier, which is here designated by 81 and operates in symmetrical configuration. The first differential amplifier 81 hence has two output terminals, which define, respectively, the first output node $N_{OUT1}$ and a second output node $N_{OUT2}$. Present on the second output node $N_{OUT2}$ is a second output voltage $V_{OUT2}$; present, instead, between the second output node $N_{OUT2}$ and the first output node $N_{OUT1}$ is a third output voltage $V_{DIFF}$.

The testing circuit 70 further comprises an additional capacitor $C_{F2}$, which is the same as the detection capacitor $C_{F1}$, but is connected between the positive input terminal of the first operational amplifier 81 and the second output node $N_{OUT2}$. Moreover, the testing circuit 70 comprises a fifth switch 94 and a sixth switch 96. The fifth switch 94 is arranged between the positive input terminal of the first differential amplifier 81 and ground, whilst the sixth switch 96 is arranged between the second output node $N_{OUT2}$ and the third supply voltage $V_{DD}/2$.

The testing circuit 70 further comprises a detection stage 83, which has four input terminals, two of which are respectively connected to the first and second output nodes $N_{OUT1}$, $N_{OUT2}$, the remaining two input terminals are set, respectively, at the first reference voltage REF1 and at a second reference voltage REF2.

In this case, for testing the integrity of the pixel 101, it is possible to carry out the following operations, described with reference to FIG. 10.

Initially, at the instant $t_0$, the first and fourth switches 72, 78 are open, whereas the second, third, fifth, and sixth switches 74, 76, 94, 96 are closed. Purely by way of example, FIG. 9 refers to the instant $t_0$.

Moreover, between the instants $t_{BOT1}$ and $t_{BOT2}$ the operations already described in regard to FIG. 8 are carried out. All the membranes are hence latched, in a way in itself known, to the corresponding bottom plates SRB.

Next, at the instant $t_{HZ1}$, the control unit 150 controls the first top-electrode driving circuit 84 and the first bottom-electrode driving circuit 86 in such a way that they operate in high-impedance mode.

Then, at the instant $t_{SW1}$, the first and fourth switches 72, 78 are closed by the control unit 150.

Next, at the instant $t_{SW2}$, the second, third, fifth, and sixth switches 74, 76, 94, 96 are opened by the control unit 150.

The control unit 150 then applies the first stimulation signal to the input terminal $IN_{M1}$ of the first membrane-electrode driving circuit 88.

In these conditions, at the instant $t_1$, the third output voltage $V_{DIFF}$ is zero, and then increases until it assumes, at the instant $t_2$, a value $V_{DIFF_t2}=(V_{D2}-V_D)*(C_2-C_1)/C_F$, where $C_1$ and $C_2$ are the capacitances of the first and second capacitors, and $C_F$ is the capacitance of the detection capacitor $C_{F1}$ and of the additional capacitor $C_{F2}$, which, as mentioned previously, are the same as one another.

Next, at the instant $t_{SW3}$, the second, third, fifth, and sixth switches 74, 76, 94, 96 are closed so as to charge again the detection capacitor $C_{F1}$ to a voltage equal to the third supply voltage $V_{DD}/2$, maintaining the feedback of the first differential amplifier 80.

Then, at the instant $t_{SW4}$, the first and fourth switches 72, 78 are opened.

Next, just the first membrane 32 is latched to the first top plate 42, in a way in itself known; the other membranes 2 of the MEMS speaker 1 remain latched, instead, to the corresponding bottom plates SRB. The operations latch the first membrane 32 to the first top plate 42 occur in a time interval comprised between the instant $t_{TOP1}$ and the instant $t_{TOP2}$.

Next, at the instant $t_{HZ2}$, the first top-electrode driving circuit 84 and the first bottom-electrode driving circuit 86 are controlled, in a way in itself known, so as to operate in high-impedance mode.

Then, at the instant $t_{SW5}$, the first and fourth switches 72, 78 are closed.

Next, at the instant $t_{SW6}$, the second, third, fifth, and sixth switches 74, 76, 94, 96 are opened.

The control unit 150 then applies the second stimulation signal to the input terminal $IN_{M1}$ of the first membrane-electrode driving circuit 88.

In these conditions, at the instant $t_3$ the third output voltage $V_{DIFF}$ is zero, and then decreases until it assumes, at the instant $t_4$, a value $V_{DIFF_t4}=(V_{D2}-V_D)*(C_2-C_1)/C_F$.

Next, at the instant $t_{SW7}$, the second, third, fifth, and sixth switches 74, 76, 94, 96 are closed. Finally, at the instant $t_{SW8}$, the first and fourth switches 72, 78 are opened.

In greater detail, the first and second reference voltages REF1, REF2 are set in a way in itself known, on the basis of the expected deflection of the first membrane 32, and hence on the basis of the corresponding expected values of the capacitances of the first and second capacitors $C_1$, $C_2$, when the first membrane 32 is latched to the first bottom plate 52 and to the first top plate 42, and on the hypothesis that the first membrane 32 is mobile according to the design of the MEMS speaker 1.

In particular, it is possible to set the first and second reference voltages REF1, REF2 in such a way that, in the case where the pixel 101 is intact, the relation $V_{DIFF_t4}<REF2<REF1<V_{DIFF_t2}$ applies, where REF1>0 and REF2<0.

In detail, in the case where the pixel 101 is intact, the third output voltage $V_{DIFF}$ respects a third condition. The third condition envisages that, during the aforementioned inspection time window, the third output voltage $V_{DIFF}$ exceeds the first reference voltage REF1 only within the interval comprised between the instants $t_1$ and $t_2$, and in particular within of a subinterval comprised between an instant $t_{w1}$ and the instant $t_2$. In addition, the second condition envisages that the third output voltage $V_{DIFF}$ is lower than the second reference voltage REF2 only within the interval comprised between the instants $t_3$ and $t_4$, and in particular within a subinterval comprised between an instant $t_{w2}$ and the instant $t_4$.

Respect of the third condition, and hence the integrity of the pixel 101, can be verified, for example, by the detection stage 83, which for this purpose operates in a way in itself known. The detection stage 83 hence detects, in a way in itself known, respect of the relations $V_{DIFF_t4}<REF2$ and $V_{DIFF_t2}>REF1$.

Figure 10:
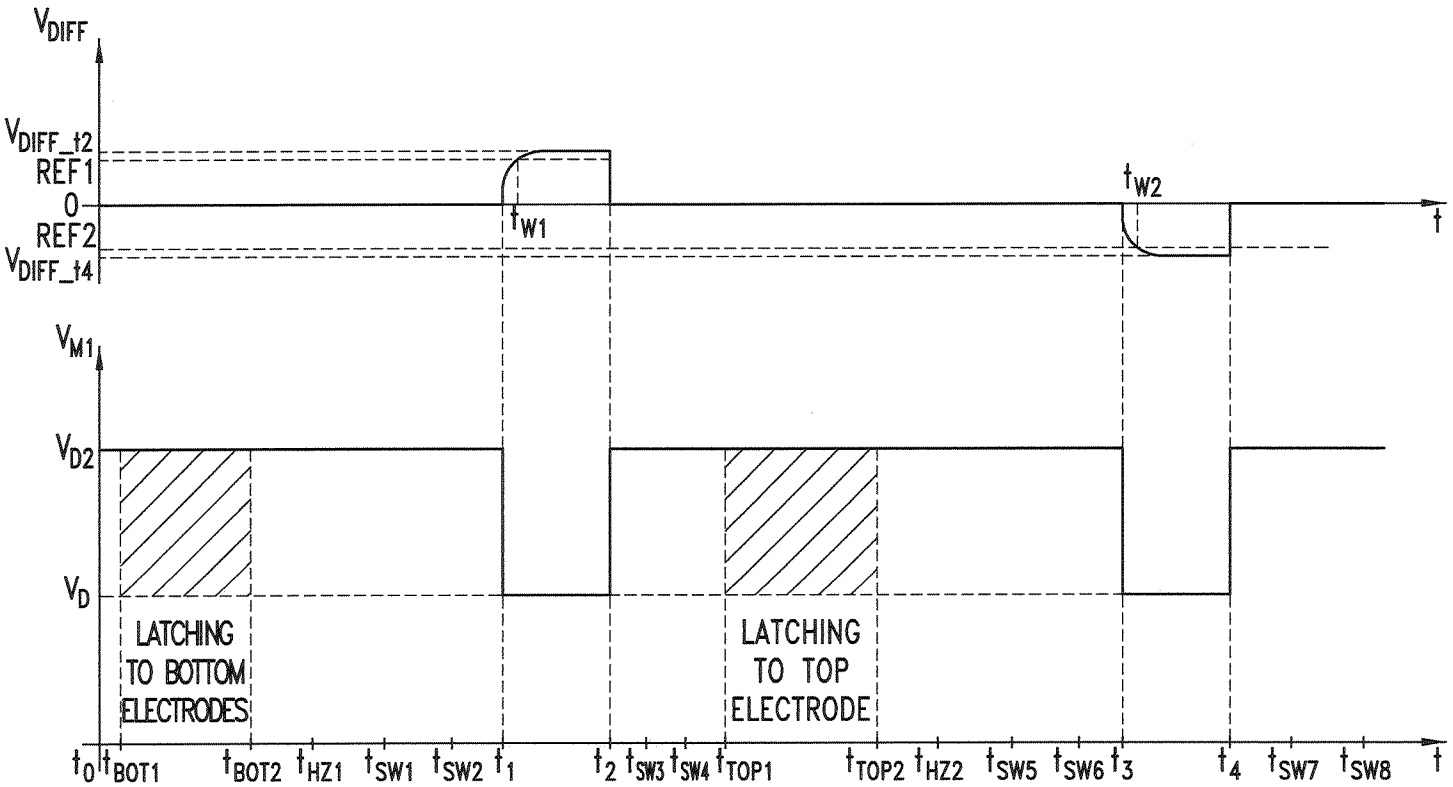

In practice, the operations shown in FIG. 10 envisage generation of a signal proportional to the difference between the capacitances of the first and second capacitors $C_1$, $C_2$. In other words, the operations performed between the instant $t_{HZ1}$ and the instant $t_2$ enable measurement of the difference between the capacitances of the first and second capacitors $C_1$, $C_2$, when the first membrane 32 is latched to the first bottom plate 52, and more precisely when the first membrane 32 should be latched to the first bottom plate 52, in the case of intact pixel.

Moreover, the operations performed between the instant $t_{HZ2}$ and the instant $t_4$ enable measurement of the difference between the capacitances of the first and second capacitors $C_1$, $C_2$, when the first membrane 32 is latched to the first top plate 42, and more precisely when the first membrane 32 should be latched to the first top plate 42, in the case of intact pixel. On the basis of these measurements, it is possible to determine the integrity of the pixel 101. Moreover, for practical purposes, the plots of the third output voltage $V_{DIFF}$ during the intervals $[t_1, t_2]$ and $[t_3, t_4]$ form corresponding measurement signals.

The advantages that the present speaker device affords emerge clearly from the foregoing description. In particular, the present speaker device 20 can be tested in accurately and in a way that is substantially immune from possible parasitic capacitance. In addition, the present speaker device 20 comprises a single testing circuit, which may be used for testing any pixel 101. In addition, the stimulation signals are injected into the input terminals $IN_M$ of the membrane-electrode driving circuits 8; for this purpose, these membrane-electrode driving circuits 8 are in fact used, without additional hardware. Moreover, the reference voltages present within the testing circuit can be varied in a simple way.

Finally, it is clear that modifications and variations may be made to what has been described and illustrated herein, without thereby departing from the sphere of protection of the present disclosure.

For example, the positive and negative input terminals of each one between the first and second differential amplifiers can be reversed. In this case, the relation between the first output voltage $V_{OUT1}$ and the first reference voltage REF1 is modified accordingly. It is moreover possible that, instead of the second differential amplifier 82, an analog-to-digital converter and a processing unit are present, which can likewise be present inside the detection stage 83.

As regards the second and third switches 74, 76, these can be replaced by a single switch, which is arranged in parallel to the detection capacitor $C_{F1}$. Likewise, also the fifth and sixth switches 94, 96 can be replaced by a corresponding switch, which is arranged in parallel to the additional capacitor $C_{F2}$.

It is also possible that, in order to detect for example the capacitance of the first capacitor $C_1$ or else of the second capacitor $C_2$ of any pixel, there is not previously carried out latching of all the membranes to the corresponding bottom plates. In other words, to detect the integrity of each pixel, it is sufficient to latch, at different instants, just the corresponding membrane to the corresponding top plate and to the corresponding bottom plate, in a way altogether independent of what occurs in the other pixels. In addition, for the purposes of the present disclosure, it is irrelevant whether this corresponding membrane is latched first to the bottom plate and then to the top plate, or vice versa. For example, it is thus possible that, after latching all the membranes to the bottom plates, the capacitances of the corresponding first capacitors are measured, and then all the membranes are latched to the corresponding top plates, and finally the capacitances of the corresponding first capacitors are measured again. Alternatively, and once again purely by way of example, it is possible that, after latching all the membranes to the bottom plates, for each membrane the capacitance of the corresponding first capacitor is measured, the membrane is latched to the corresponding top plate, and then the capacitance of the corresponding first capacitor is measured again, before iterating the operations on the next membrane.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A microelectromechanical system speaker device, comprising:

an elementary unit, said elementary unit including:

a membrane;

a top plate; and a bottom plate, the membrane being between the top plate and the bottom plate and forming a first capacitor and a second capacitor, with the top plate and with the bottom plate, respectively;

an electronic driving circuit configured to, during a first operating period, move the membrane into a first position, in which the membrane is closer to the bottom plate, and during a second operating period, to move the membrane into a second position, in which the membrane is closer to the top plate;

an electronic test circuit including:

a first measuring circuit configured to generate a first measurement signal that is proportional to a capacitance of a first one of the first and second capacitors, after the first operating period that corresponds to the membrane being in the first position, said first measuring circuit being configured to generate a second measurement signal that is proportional to the capacitance of said first one of the first and second capacitors, after the second operating period that corresponds to the membrane being in the second position; and a first comparator circuit configured to compare said first and second measurement signals with at least one first electrical reference quantity, and to detect a mobility of the membrane in a direction of the top plate or the bottom plate, based on the comparison, the first comparator circuit being configured to detect that, if the capacitance is from the first capacitor, the first measurement signal does not exceed the first electrical reference quantity and the second measurement signal exceeds said first electrical reference quantity.

2. The device according to claim 1 wherein the first comparator circuit is configured to detect that if the capacitance is from the second capacitor, the first measurement signal exceeds the first electrical reference quantity, and the second measurement signal does not exceed said first electrical reference quantity.

3. The device according to claim 2 wherein the electronic test circuit includes:

a second measuring circuit configured to generate a third measurement signal proportional to the capacitance of a second one of said first and second capacitors, after the first operating period, said second measuring circuit being configured to generate a fourth measurement signal proportional to the capacitance of the second one of said first and second capacitors, after the second operating period; and a second comparator circuit designed to compare said third and fourth measurement signals with a second electrical reference quantity, for detecting the mobility of the membrane in the direction of the top plate or the bottom plate.

4. The device according to claim 1 wherein the first measuring circuit is further configured to generate a third measurement signal that is proportional to a difference between capacitances of said first and second capacitors, after the first operating period, and generate a fourth measurement signal that is proportional to the difference between the capacitances of said first and second capacitors, after the second operating period.

5. The device according to claim 4 wherein the first comparator circuit is configured to detect that:

a first one of the third and fourth measurement signals exceeds a second electrical reference quantity; and a second one of said third and fourth measurement signals is lower than a third electrical reference quantity, which is lower than the second electrical reference quantity.

6. The device according to claim 1 wherein said electronic driving circuit includes a top-electrode driving circuit, a membrane driving circuit and a bottom-electrode driving circuit, coupled to the top plate, to the membrane, and to the bottom plate, respectively, said top-electrode driving circuit, said membrane driving circuit, and said bottom-electrode driving circuit being configured to generate a top-electrode driving signal, a membrane driving signal, and a bottom-electrode driving signal, respectively, the top-electrode driving signal, the membrane driving signal, and the bottom-electrode driving signal being configured to cause movement of the membrane alternatively towards the top plate and towards the bottom plate when the elementary unit is operational.

7. The device according to claim 6 wherein during said first operating period:

at a first instant in time, the top-electrode driving signal and the bottom-electrode driving signal are equal to a first voltage, and the membrane driving signal is equal to a second voltage;

at a second instant in time, the top-electrode driving signal and the membrane driving signal are equal to a third voltage, and the bottom-electrode driving signal is equal to the first voltage; and at a third instant in time, the top-electrode driving signal and the bottom-electrode driving signal are equal to the first voltage, and the membrane driving signal is equal to the second voltage;

and wherein, during said second operating period:

at a first instant in time, the top-electrode driving signal and the bottom-electrode driving signal are equal to the first voltage, and the membrane driving signal is equal to the second voltage;

at a second instant in time, the bottom-electrode driving signal and the membrane driving signal are equal to the third voltage, and the top-electrode driving signal is equal to the first voltage; and at a third instant in time, the top-electrode driving signal and the bottom-electrode driving signal are equal to the first voltage, and the membrane driving signal is equal to the second voltage.

8. The device according to claim 6, further comprising a coupling circuit configured to uncouple electrically the first measuring circuit from the top plate or the bottom plate, during said first and second operating periods, and to couple the first measuring circuit to the top plate or the bottom plate, in periods other than said first and second operating periods; and wherein the membrane driving circuit is configured to generate a first pulse and a second pulse, respectively after the first and second operating periods.

9. The device according to claim 8 wherein said first measuring circuit includes at least one amplifier with capacitive feedback, which is configured to amplify said first and second pulses.

10. The device according to claim 1 wherein the first measuring circuit is configured to generate a third measurement signal based on a difference between capacitances of the first and second capacitors after the first operating period, and the first measuring circuit is configured to generate a fourth measurement signal based on a difference between the capacitances of the first and second capacitors after the second operating period.

11. A method, comprising:

testing a microelectromechanical system speaker device, the testing including:

operating at least one elementary unit in a first operating period and a second operating period with a driving device, said elementary unit including a membrane, a top plate, and a bottom plate, the membrane being arranged between the top plate and the bottom plate and forming a first capacitor and a second capacitor, respectively with the top plate and with the bottom plate, the operating including:

moving the membrane into a first position, in which the membrane is close to the bottom plate in the first operating period; and moving the membrane into a second position, in which the membrane is close to the top plate during a second operating period;

after the first operating period that corresponds to the membrane being in the first position, generating a first measurement signal that is proportional to a capacitance of a first one of said first and second capacitors;

after the second operating period that corresponds to the membrane being in the second position, generating a second measurement signal that is proportional to the capacitance of said first one of said first and second capacitors; and detecting a mobility of the membrane in a direction of the top plate or the bottom plate that forms said first one of said first and second capacitors, said detecting the mobility including:

comparing said first and second measurement signals with a first electrical reference quantity; and detecting that, if the capacitance is from the first capacitor, the first measurement signal does not exceed the first electrical reference quantity and the second measurement signal exceeds said first electrical reference quantity.

12. The method according to claim 11, further comprising detecting that, if the capacitance is from the second capacitor, the first measurement signal exceeds the first electrical reference quantity, and the second measurement signal does not exceed said first electrical reference quantity.

13. The method according to claim 12, further comprising:

generating, after the first operating period, a third measurement signal proportional to a capacitance of a second one of said first and second capacitors;

generating, after the second operating period, a fourth measurement signal proportional to the capacitance of said second one of said first and second capacitors; and detecting the mobility of the membrane in the direction of the top plate or the bottom plate that forms said second one of said first and second capacitors, said detecting including comparing said third and fourth measurement signals with a second electrical reference quantity.

14. The method according to claim 11 wherein the operating is performed using an electronic driving circuit that includes a top-electrode driving circuit, a membrane driving circuit, and a bottom-electrode driving circuit, which are coupled to the top plate, to the membrane, and to the bottom plate, respectively, said method further comprising:

electrically uncoupling, during said first and second operating periods, the first measuring circuit from the top plate or the bottom plate that forms the capacitance;

coupling, in periods other than said first and second operating periods, the first measuring circuit to the top plate or the bottom plate that forms the capacitance; and generating, using the membrane driving circuit, a first pulse and a second pulse, respectively after the first and second operating periods.

15. The method according to claim 14 wherein the generating the first and second measurement signals includes amplifying said first and second pulses.

16. The method according to claim 11, further comprising:

generating a third measurement signal that is proportional to a difference between capacitances of said first and second capacitors; and generating a fourth measurement signal to be proportional to the difference between the capacitances of said first and second capacitors.

17. The method according to claim 16, further comprising detecting whether:

a first one of the third and fourth measurement signals exceeds a second electrical reference quantity; and a second one of said third and fourth measurement signals is lower than a third electrical reference quantity, which is lower than the second electrical reference quantity.

18. The method according to claim 16 wherein the operating is performed using an electronic driving circuit that includes a top-electrode driving circuit, a membrane driving circuit, and a bottom-electrode driving circuit, which are, coupled to the top plate, to the membrane, and to the bottom plate, respectively, said method further comprising:

during said first and second operating periods, electrically uncoupling the first measuring circuit from the top plate and from the bottom plate;

in periods other than said first and second operating periods, coupling the first measuring circuit to the top plate and to the bottom plate; and generating, using the membrane driving circuit, a first pulse and a second pulse, respectively after the first and second operating periods.

19. A system, comprising:

a microelectromechanical system speaker, including:

a membrane;

a first plate; and a second plate, the membrane being between the first plate and the second plate, the membrane forming a first capacitor with the first plate;

a driving circuit configured to move the membrane in to a first position or a second position, the membrane being closer to the first plate in the first position, the membrane is closer to the second plate in the second position; and a test circuit including:

a measuring circuit configured to generate a first measurement signal that is proportional to a capacitance of the first capacitor in response to the membrane being moved in to the first position by the driving circuit, and generate a second measurement signal that is proportional to a capacitance of the first capacitor in response to the membrane being moved in to the second position by the driving circuit; and a comparator circuit configured to determine whether the first and second measurement signals exceeds an electrical reference quantity, the comparator circuit configured to detect that, if the capacitance is from the first capacitor, the first measurement signal does not exceed the electrical reference quantity and the second measurement signal exceeds the electrical reference quantity.

20. The system of claim 19, wherein the membrane forms a second capacitor with the second plate, the measuring circuit is further configured to generate a third measurement signal that is proportional to a capacitance of the second capacitor in response to the membrane being moved in to the first position by the driving circuit and generate a fourth measurement signal that is proportional to a capacitance of the second capacitor in response to the membrane being moved in to the second position by the driving circuit, and the comparator circuit is further configured to determine whether the third and fourth measurement signals exceeds the electrical reference quantity.

21. The system of claim 19, wherein the membrane forms a second capacitor with the second plate, the measuring circuit is further configured to generate a third measurement signal that is proportional to a difference between capacitances of the first and second capacitors in response to the membrane being moved in to the first position and generate a fourth measurement signal that is proportional to a difference between capacitances of the first and second capacitors in response to the membrane being moved in to the second position, and the comparator circuit is further configured to determine whether the third and fourth measurement signals exceeds the electrical reference quantity.

* * * * *